US006651855B1

(12) United States Patent
Flynn

(10) Patent No.: US 6,651,855 B1
(45) Date of Patent: Nov. 25, 2003

(54) PRY BAR HOLDER

(76) Inventor: William T. Flynn, 2053 E. Bayshore Rd., #13, Redwood City, CA (US) 94063

( * ) Notice: Subject to any disclaimer, the term of this patent is extended or adjusted under 35 U.S.C. 154(b) by 46 days.

(21) Appl. No.: 09/816,013

(22) Filed: Mar. 22, 2001

(51) Int. Cl.[7] ..... A45F 5/00

(52) U.S. Cl. ..... 224/251; 260/349; 224/904

(58) Field of Search ..... 224/251, 255, 224/256, 269, 904, 915, 232, 234, 249; 221/66, 70.6; 206/806, 461, 471, 349, 776

(56) References Cited

U.S. PATENT DOCUMENTS

| | | | | | |
|---|---|---|---|---|---|
| 1,486,820 | A | * | 3/1924 | Wilder | 254/25 |
| 2,896,910 | A | | 7/1959 | Cooper et al. | |
| 3,134,574 | A | | 5/1964 | Reuterfors | |
| 3,307,756 | A | * | 3/1967 | Brunosson et al. | 224/232 |
| 3,680,834 | A | | 8/1972 | Holloway | |
| D286,949 | S | * | 12/1986 | Hardman | D3/106 |
| 4,819,847 | A | * | 4/1989 | Anderson | 224/669 |
| 4,844,416 | A | | 7/1989 | Hand | |
| 5,511,705 | A | * | 4/1996 | Dreszer | 224/582 |
| 5,695,172 | A | | 12/1997 | Hreha | |
| 6,102,264 | A | | 8/2000 | Redzisz | |

FOREIGN PATENT DOCUMENTS

| | | |
|---|---|---|
| CA | 1063092 | 9/1979 |

* cited by examiner

*Primary Examiner*—Lee Young
*Assistant Examiner*—Lien Ngo
(74) *Attorney, Agent, or Firm*—Edward S. Wright

(57) ABSTRACT

Holder for a pry bar of the type having an elongated handle, a claw extending in a direction generally perpendicular to the handle, and an outwardly curved fulcrum interconnecting the handle and the claw. The holder includes a loop through which the handle can be inserted in a vertical direction, a seat positioned above the loop for engaging the claw to support the pry bar in a hanging position with the handle captured by the loop, and a bumper below the loop for lateral engagement by the handle to keep the claw on the seat.

13 Claims, 3 Drawing Sheets

PRY BAR HOLDER

This invention pertains generally to tool holders and, more particularly, to a belt-mounted holder for a pry bar.

Pry bars of the type shown in FIG. 1, designated generally by the reference numeral 11, have been used in demolition and construction for a number of years. They are useful in nail extraction and in a number of other prying and lifting applications. Such tools are fabricated of a flat metal bar which is bent to form an elongated handle 12 with nail pulling claws 13, 14 at opposite ends thereof. Claw 13 extends in a direction generally perpendicular to the handle, with a heel curve or fulcrum 16 interconnecting that claw with the handle. The portion of the handle near claw 14 is arched to provide a fulcrum for that claw, and a nail puller 17 is formed in the bar near the base of the arch. Pry bars of this general type are shown in U.S. Pat. No. 3,134,574 and are marketed by Vaughan and Bushnell Mfg. Co. under the trademark SUPERBAR.

As useful as these pry bars are, carrying them is a problem. They are too long to fit in the bags or pouches on most tool belts, and they tend to slip through the loops provided for holding hammers and the like on such belts. As a consequence, they are generally carried only in tool boxes or by hand, which means that they are often not readily available when needed and are easily misplaced or lost.

It is in general an object of the invention to provide a new and improved tool holder which is particularly suitable for use in carrying pry bars.

Another object of the invention is to provide a tool holder of the above character which can be used with existing tool belts.

These and other objects are achieved in accordance with the invention by providing a holder for a pry bar having a loop through which the handle of the pry bar can be inserted in a vertical direction, a seat positioned above the loop for engaging a horizontally extending claw at one end of the pry bar to support the pry bar in a hanging position with the handle captured by the loop, and a bumper below the loop for lateral engagement by the handle to keep the claw on the seat.

Figure 2:
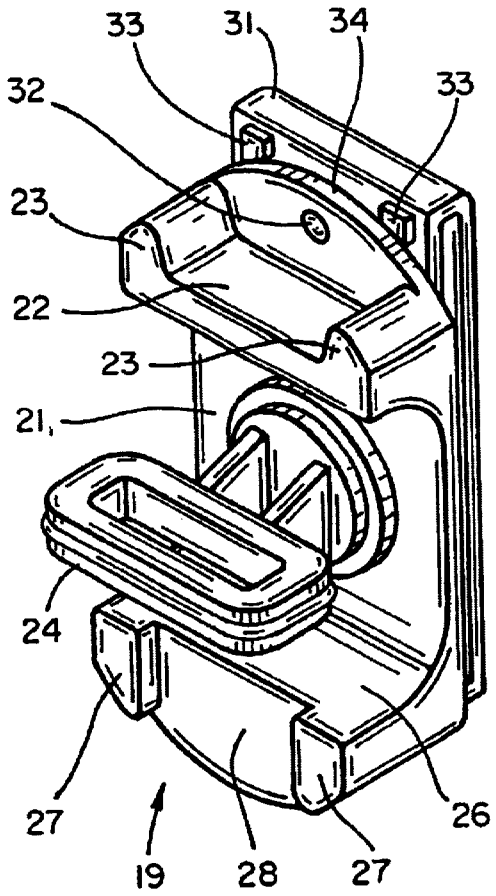
FIG. 2 is an isometric view of one embodiment of a pry bar holder according to the invention.

In the embodiment illustrated in FIG. 2, the pry bar holder 19 has a molded base 21 which is fabricated of an impact resistant, rigid plastic material. Toward its upper end, the base is provided with a horizontally extending seat 22 for receiving the claw at one end of the pry bar. Raised shoulders 23 toward the edges of the seat keep the pry bar from sliding laterally off the seat.

A loop 24 is disposed centrally of the base below the seat for receiving the handle of the pry bar, and a bumper 26 is positioned below the loop for lateral engagement with the handle of the pry bar. Outwardly extending lugs 27 at the edges of the bumper form a recess 28 for the handle.

In this particular embodiment, loop 24 is formed as a separate part which is permanently affixed to base 21 to form a unitary structure.

Base 21 is pivotally attached to a clip 31 which can be hooked over the belt of a worker. That belt can, for example, be a tool belt or a regular belt, and the clip can also be engaged with another part of the worker's clothing such as the waistband or a pocket of his pants. The base is attached to the clip by a rivet 32 which allows the bar to swing back and forth as the worker walks, with the amount of swing being limited by a pair of lugs 33 which protrude from the outer face of the clip for engagement with the upper edge 34 of the base. Alternatively, the tool holder can be permanently attached to a tool belt or other belt by eliminating the clip and riveting or otherwise connecting the base directly to the belt.

With the tool holder on his belt, a worker can place the pry bar 11 in the holder simply by dropping the handle 12 of the pry bar into loop 24, with claw 13 up and facing in toward the base, until the claw comes to rest on seat 22. At that point, the pry bar will hang from the seat, with the handle captured by the loop and bumper 26 engaging the inner side of the handle to prevent the bar from pivoting about the loop and drawing the claw off the seat. Shoulders 23 and lugs 27 keep the bar in place laterally on the seat and the bumper. The pry bar is thus held securely in the holder, with fulcrum 16 extending outwardly away from the base and providing an easy means by which the worker can grasp the bar to withdraw it from the holder.

To withdraw the pry bar from the holder, the worker simply slides his fingers under claw 13 and into the area bounded by fulcrum 16, grasps the bar by the claw and fulcrum, and lifts the bar in an upward direction until the handle 12 and lower claw 14 are clear of the loop.

Figure 5:
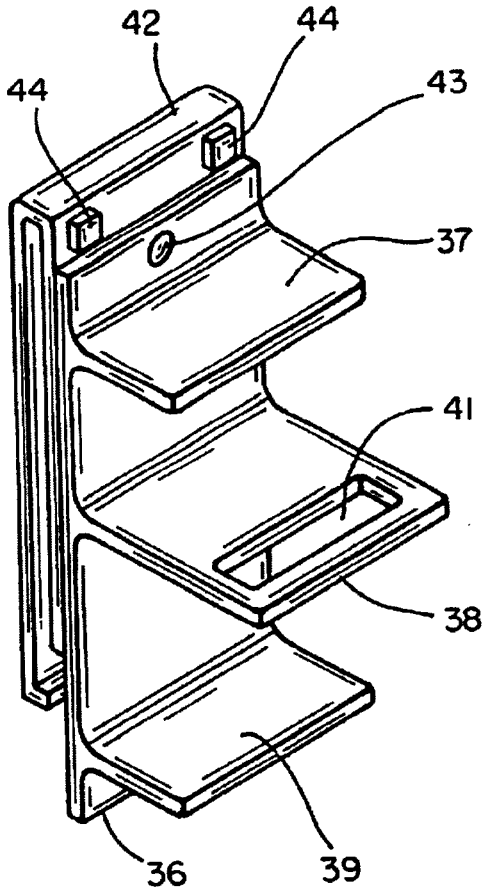
FIG. 5 is an isometric view of another embodiment of a pry bar holder according to the invention.
Figure 3:
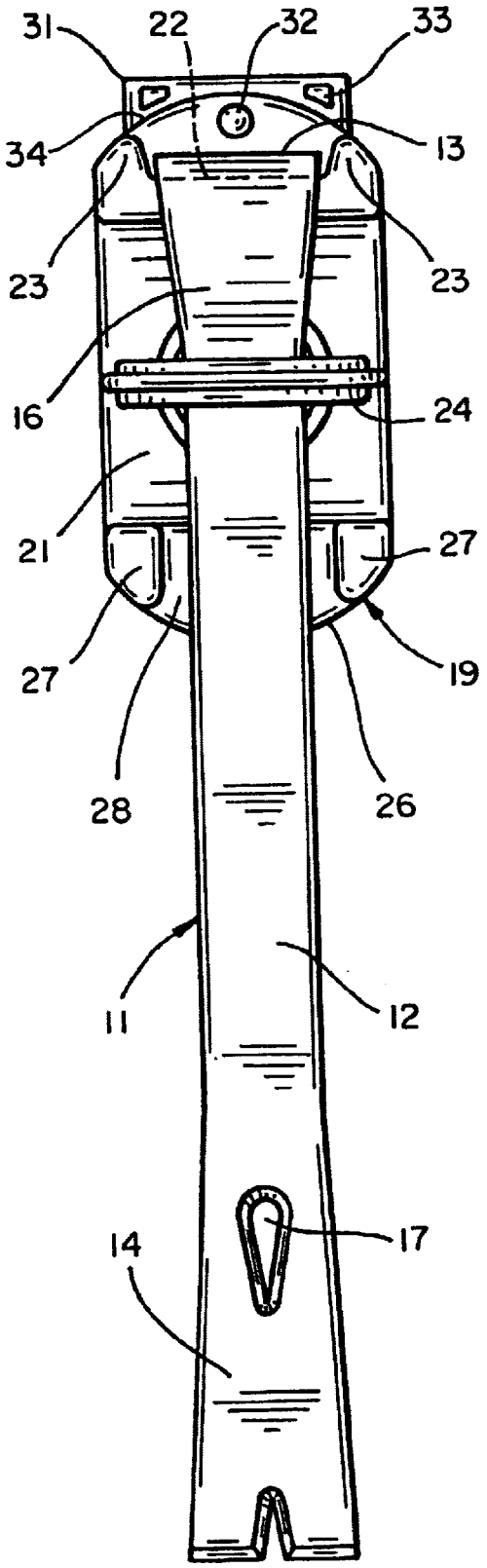
FIG. 3 is a front elevational view of the embodiment of FIG. 2 carrying a pry bar.
Figure 4:
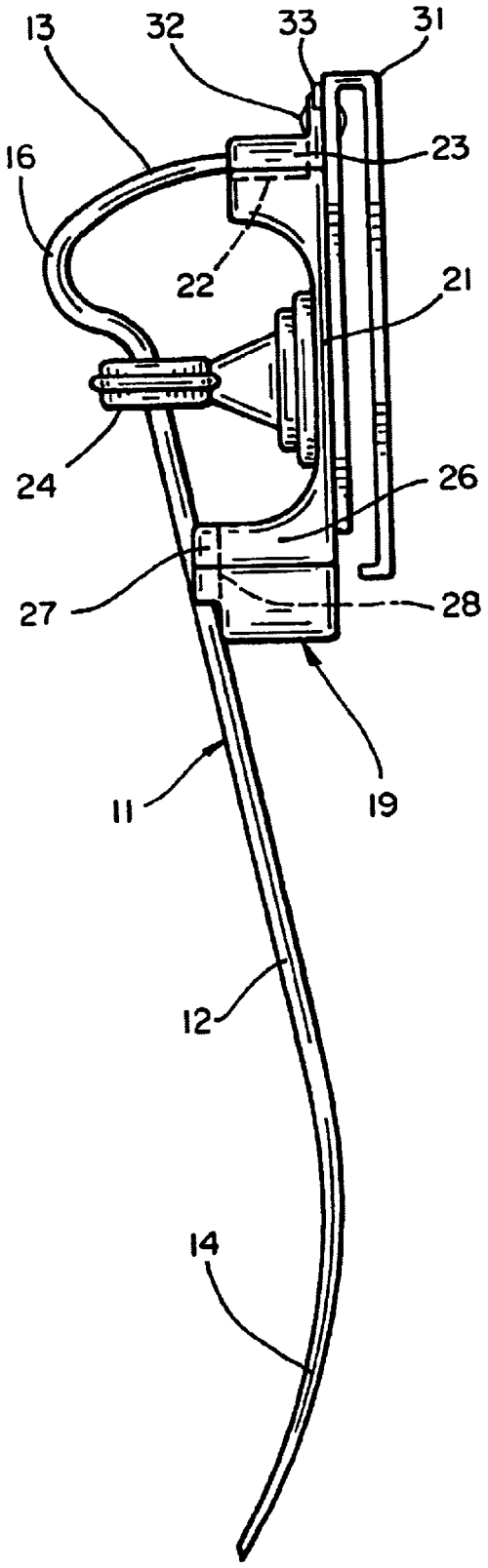
FIG. 4 is a side elevational view of the embodiment of FIG. 2 carrying a pry bar.

In the embodiment of FIG. 5, the pry bar holder has an upright base plate 36, with an upper flange 37, a central flange 38 and a lower flange 39 projecting laterally therefrom. The central flange projects farther than the other two flanges, and an elongated opening 41 is formed in the outer portion of that flange to provide a loop for receiving the handle of the pry bar. In this embodiment, flange 37 serves as the seat for receiving the horizontally extending claw of the pry bar, and flange 39 serves as the bumper for the handle.

The base plate and flanges are preferably fabricated as a unitary structure of a lightweight, rigid material such as aluminum, and that structure is conveniently formed by an extrusion process.

Base plate 36 is pivotally connected to a belt clip 42 by a rivet 43, with lugs 44 projecting from the outer face of the clip to limit the amount of swing. Alternatively, the base plate can be attached directly to a tool belt or the like, as in the embodiment of FIG. 1.

Figure 1:
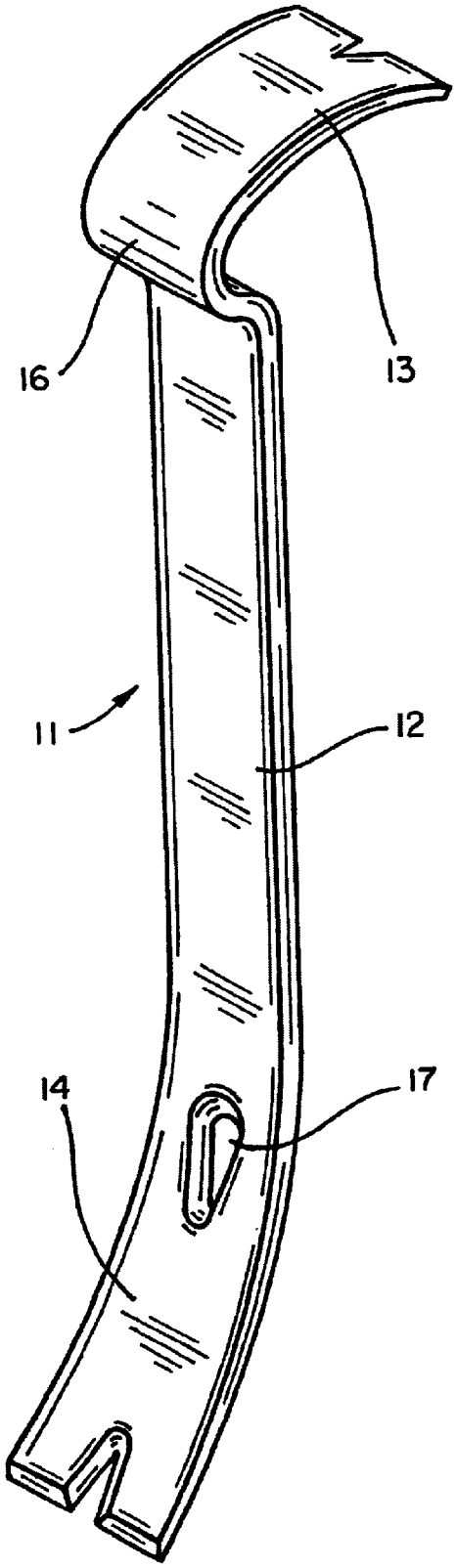
FIG 1 (PRIOR ART)
FIG. 1 is in isometric view of an existing pry bar of a type with which the invention can be used.

Operation and use of the embodiment of FIG. 5 is similar to that of the embodiment of FIG. 1. When the pry bar is inserted into the holder, claw 13 rests on the upper surface of flange 37, with the handle captured in the opening 41 in flange 38 and resting against the outer edge of flange 39. The pry bar is thus held securely in place, yet is easily removed as discussed above.

It is apparent from the foregoing that a new and improved pry bar holder has been provided. While only certain presently preferred embodiments have been described in detail, as will be apparent to those familiar with the art, certain changes and modifications can be made without departing from the scope of the invention as defined by the following claims.

What is claimed is:

1. A holder for a pry bar having an elongated handle, a claw extending in a direction generally perpendicular to the handle, and an outwardly curved fulcrum interconnecting the handle and the claw, with a lateral offset between the claw and the handle, comprising: a loop through which the handle can be inserted in a vertical direction, a rigid seat positioned above the loop and offset laterally of the loop by a distance corresponding to the offset between the claw and the handle for engaging the claw to support the pry bar in a hanging position with the handle beg constrained by the loop against any substantial lateral movement, and a bumper below the loop for engagement with the handle to prevent the pry bar from pivoting about the loop and drawing the claw off the seat.

2. A holder for a pry bar having an elongated handle, a claw extending in a direction generally perpendicular to the handle, and an outwardly curved fulcrum interconnecting the handle and the claw, with a lateral offset between the claw and the handle, comprising: a hanger adapted to be attached to a worker's belt, a vertically extending base pivotally connected to the hanger, a loop extending laterally from the base with an opening through which the handle of the pry bar can be inserted, a rigid seat projecting laterally from the base above the loop and offset laterally of the loop by a distance corresponding to the offset between the claw and the handle for engaging the claw to support the pry bar in a hanging position with the handle passing through the opening and being constrained by the loop from any substantial lateral movement, and a bumper on the base below the loop for lateral engagement by the handle to keep the claw on the seat.

3. In combination: a holder having a loop, a rigid seat positioned above the loop, and a bumper below the loop; and a pry bar hanging from the holder and having a horizontally extending claw which rests on the rigid seat, an elongated handle hanging down through the loop and laterally engaging the bumper, and an outwardly curved fulcrum interconnecting the handle and the claw.

4. The combination of claim 3 including means for attaching the holder to a worker's belt.

5. The combination of claim 4 wherein the means for attaching the holder to the worker's belt comprises a clip adapted to be hooked onto the belt, and means pivotally connecting the holder to the clip.

6. The holder of claim 1 including a pair of raised shoulders on the seat for abutment by opposite edges of the claw of the pry bar to prevent the claw from sliding off the seat.

7. The holder of claim 1 including a pair of lugs projecting outwardly from the bumper and forming a recessed area for receiving the handle of the pry bar.

8. The holder of claim 2 including a pair of raised shoulders on the seat for engagement with opposite edges of the claw of the pry bar to prevent the claw from sliding off the seat.

9. The holder of claim 2 including a pair of lugs projecting outwardly from the bumper and forming a recessed area for receiving the handle of the pry bar.

10. A holder for a pry bar having an elongated handle, a claw extending in a direction generally perpendicular to the handle, and an outwardly curved fulcrum interconnecting the handle and the claw, comprising: a vertically extending base, a substantially horizontal seat extending outwardly from the base for receiving the claw of the pry bar and supporting the pry bar in a hanging position with the fulcrum facing in an outward direction away from the base and the handle extending in a downward direction, a loop spaced outwardly from the base below the seat and having an opening corresponding generally in size and in shape to the cross section of the handle for encircling the handle and constraining the handle against lateral movement when the pry bar is hanging from the shoulder horizontal seat, and a bumper extending outwardly from the base below the loop for lateral engagement with the handle to prevent the handle from pivoting about the loop in an inward direction and drawing the claw off the seat.

11. A holder for a pry bar having an elongated handle and a claw which is generally perpendicular to the handle, comprising a vertically extending base, a substantially horizontal seat extending outwardly from the base with raised shoulders toward opposite sides of the seat for receiving the claw of the pry bar between the shoulders and supporting the pry bar in a hanging position, a loop spaced outwardly from the base below the seat for encircling the handle of the pry bar, and a bumper extending outwardly from the base and having a pair of outwardly projecting lugs which define a recessed area for receiving the handle.

12. A pry bar holder comprising a vertically extending base, a substantially horizontal seat which extends from the base in an outward direction and has raised shoulders toward opposite sides thereof, a loop positioned outwardly of and below the seat, and a bumper which extends outwardly from the base below the loop and has a pair of outwardly protruding lugs that define a recessed area which opens through an outer face of the bumper.

13. A holder for a pry bar having an elongated handle, a claw extending in a direction generally perpendicular to the handle, and an outwardly curved fulcrum interconnecting the handle and the claw, with a lateral offset between the claw and the handle, comprising a vertically extending base, a rigid seat which extends outwardly from the base for receiving the claw of the pry bar, a loop positioned below the seat having an opening which is spaced outwardly of the seat by a distance corresponding to the offset between the claw and the handle of the pry bar for receiving the handle and Preventing the handle from swinging away from the base when the claw is resting upon the seat, and a bumper which is positioned below the loop and extends outwardly from the base to a lesser extent than the loop for engaging the handle to prevent the handle from swinging inwardly toward the base.

* * * * *